US007277656B2

(12) United States Patent
Nakayama

(10) Patent No.: US 7,277,656 B2
(45) Date of Patent: Oct. 2, 2007

(54) IMAGE FORMING APPARATUS HAVING CHARGING DEVICE WITH GRID CLEANER

(75) Inventor: Tohru Nakayama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 34 days.

(21) Appl. No.: 11/316,351

(22) Filed: Dec. 23, 2005

(65) Prior Publication Data

US 2006/0159484 A1 Jul. 20, 2006

(30) Foreign Application Priority Data

Dec. 24, 2004 (JP) ..... 2004-372850

(51) Int. Cl.
*G03G 15/02* (2006.01)

(52) U.S. Cl. ..... 399/100

(58) Field of Classification Search ..... 399/100, 399/101, 115, 170, 171, 311; 361/225, 229; 250/324, 325, 326
See application file for complete search history.

(56) References Cited

U.S. PATENT DOCUMENTS 3,875,407 A * 4/1975 Hayne ..... 399/100
3,958,877 A * 5/1976 Menon et al. ..... 399/99
5,341,201 A * 8/1994 Kedarnath et al. ..... 399/355
5,485,251 A * 1/1996 Kita et al. ..... 399/343
7,212,771 B2 * 5/2007 Tanaka et al. ..... 399/171

FOREIGN PATENT DOCUMENTS

JP 09-197771 7/1997
JP 2004347661 A * 12/2004
JP 2005215151 A * 8/2005
JP 2005227498 A * 8/2005
JP 2006047381 A * 2/2006

* cited by examiner

*Primary Examiner*—Robert Beatty
(74) *Attorney, Agent, or Firm*—Smith, Gambrell & Russell, LLP

(57) ABSTRACT

A grid cleaner 35 is fixed to a fixing holder 41 of an apparatus main body in such a way that a wet sponge 38 faces a grid 33. When a charging device 3 is made to slide in the direction indicated by arrow A, the wet sponge 38 comes into contact with a surface of the grid 33, thereby removing extraneous matters therefrom. Reference numeral 40 denotes a stopper projection that prevents the charging device 3 from being disconnected from the apparatus main body at times other than during cleaning. The stopper projection 40 extends toward a gap roller 39 side so as to serve as a guide portion 42 that prevents the wet sponge 38 of the grid cleaner 35 and the gap roller 39 from rubbing against each other.

6 Claims, 8 Drawing Sheets

IMAGE FORMING APPARATUS HAVING CHARGING DEVICE WITH GRID CLEANER

This application is based on Japanese Patent Application No. 2004-372850 filed on Dec. 24, 2004, the contents of which are hereby incorporated by reference.

BACKGROUND OF THE INVENTION

1. Field of the Invention

The present invention relates to an image forming apparatus that charges the surface of a photoconductor by using a charging device. More particularly, the present invention relates to an image forming apparatus that uses a scorotron having a grid between a corona wire and an article to be charged.

2. Description of Related Art

FIG. 6 shows the structure of a conventional image forming apparatus. Inside an image forming apparatus 1, an image formation portion P is located above a transportation belt 8. This image formation portion P forms a predetermined image through the processes of charging, exposure, development, and transfer.

The image formation portion P includes a photoconductive drum 2 that carries a visible image (a toner image), and is so constructed that a toner image formed on the photoconductive drum 2 is transferred onto a sheet (a recording medium) 6 supported/transported by the transportation belt 8 that moves adjacent to the image formation portion P, then is fixed to the sheet 6 by a fixing portion 7, and then is discharged from an apparatus main body. In FIG. 6, an image formation process is performed on the photoconductive drum 2 while rotating the photoconductive drum 2 in clockwise direction.

Next, the image formation portion P will be described in detail. There are disposed, around and above the photoconductive drum 2 that is rotatably mounted, a charging device (a charger) 3 that charges the photoconductive drum 2, an exposure unit 4 that exposes image information onto the photoconductive drum 2, a developer unit 5 that forms a toner image on the photoconductive drum 2, and a cleaning unit 9 that removes the developer (toner) remaining on the photoconductive drum 2.

First, the entire surface of the photoconductive drum 2 is uniformly charged by the charging device 3, and then the charged surface thereof is irradiated with light shone from the exposure unit 4 so as to form an electrostatic latent image on the photoconductive drum 2 according to an image signal. A toner container 10 fills the developer unit 5 with a predetermined amount of toner. The toner is supplied from the developer unit 5 to the photoconductive drum 2, and is then electrostatically attached thereto, whereby a toner image in accordance with the electrostatic latent image formed by exposure performed by the exposure unit 4 is formed thereon.

The sheet 6 onto which the toner image is transferred is accommodated in a plurality of paper feed cassettes 11*a*, 11*b*, and 11*c* that accommodate paper sheets, and a stack bypass (a manual feed tray) 11*d* located above them. The sheet 6 is fed onto the transportation belt 8 via paper feed rollers 12 and resist rollers 13, and is then transported to a position at which the photoconductive drum 2 is located. Used as the transportation belt 8 is a dielectric resin sheet that is formed into an endless belt by bonding the two ends of the sheet together or into a seamless belt.

The transportation belt 8 is stretched taut between a drive roller 14 disposed most downstream and a driven roller 15 disposed most upstream. When the transportation belt 8 starts to rotate counterclockwise, the sheet 6 is transported from the resist roller 13 onto the transportation belt 8. At this time, an image writing signal turns on, and an image is formed on the photoconductive drum 2 with predetermined timing. Then, in the electric field produced by a transfer roller 16 provided below the photoconductive drum 2 and having a predetermined transfer voltage applied thereto, the toner image on the photoconductive drum 2 is transferred onto the sheet 6. The sheet 6 is electrostatically adsorbed onto the transportation belt 8.

The sheet 6, having the toner image transferred thereon, then leaves the transportation belt 8, and is then transported to the fixing portion 7. After the transfer of the toner image, the cleaning unit 9 cleans the photoconductive drum 2, having the toner image transferred therefrom, to remove the toner remaining on the surface thereof in preparation for the formation of new electrostatic latent images. The sheet 6 transported from the transportation belt 8 to the fixing portion 7 is subjected to application of heat and pressure by a fixing roller 7*a* so as to fix the toner image to the surface of the sheet 6. In this way, a predetermined image is formed. The sheet 6 on which the image is formed is discharged to an output tray 18 by an output roller 17.

The charging device 3 used in the image forming apparatus described above has a corona wire (a charge wire) that is a thin wire made of tungsten or stainless steel. When a high voltage is applied to the corona wire electrode, discharge (corona discharge) takes place, whereby the charging device 3 charges the surface of the photoconductive drum 2. Two types of known charging devices are scorotrons having a grid electrode between the corona wire and an article to be charged, and corotrons having no grid electrode. Scorotrons are superior to corotrons in that they can perform charging control by varying the voltage applied to the grid.

FIG. 7 shows the structure of a scorotron. The charging device 3 is disposed in the width direction of the photoconductive drum 2 (in the direction perpendicular to the plane of FIG. 7), and is provided with a shield member (a casing) 31 with a C-shaped cross section having an open portion 31*a* on the surface side of the photoconductive drum 2, a corona wire 32 to which a high voltage is applied, and a grid 33 provided in the open portion 31*a*. The charging device 3 makes the surface of the photoconductive drum 2 charged to a predetermined positive potential via the grid 33 by corona discharge from the corona wire 32. However, if the grid 33 is stained with toner or the like, charging becomes unstable, resulting in degradation in image quality such as uneven density of the image at the time of image formation.

On the other hand, some elements in the air are oxidized by ozone produced by corona discharge, leading to the formation of an ion product such as NOx or SOx. The ion product thus formed and dust in the air settle on the shield member 31 and the grid 33. In general, these extraneous matters serve as insulation, and adversely affect charging characteristics of the charging device 3. Above all, when these matters adhere to the grid 33, a current supposed to flow into the grid 33 actually flows out of a grid opening into the photoconductive drum 2, leading to significant increase in the surface potential of the photoconductor. This causes problems such as a decrease in image density. Therefore, it is necessary to make the user or repair people clean the grid 33 on a regular basis or when image quality degrades, or to replace the grid 33 alone or the entire charging device 3 including the grid 33. This increases costs and trouble.

In view of the problems described above, a method of cleaning the grid surface with a simple structure is proposed.

Japanese Patent Application Laid-Open No. H9-197771 (hereinafter referred to as Patent Publication 1) discloses a method of cleaning a grid and a corona wire at the same time by making a grid cleaner having a wet sponge slide along a charging device. The ion product mentioned above is soluble in water, and therefore it is possible to easily remove contaminants strongly adhered to the grid 33 by using a grid cleaner having a wet sponge.

FIG. 8 is a partially enlarged view showing how the charging device of the conventional image forming apparatus is cleaned. When degradation of image quality is observed, or when a periodical inspection is conducted, the charging device 3 is cleaned as follows. The user first opens a front cover 34 of the apparatus main body, then takes off a storage container (not shown) for storing the recovered toner, and then fits a grid cleaner 35 to a fixing holder (not shown) provided in the vicinity of an extraction opening 36 through which the charging device 3 is pulled out.

The grid cleaner 35 is included with a spare toner container or a maintenance kit. As shown in FIG. 9, the grid container 35 is composed of a resin case 37 and a wet sponge 38 provided so as to project from a floor face 37*a* of the case 37. The wet sponge 38 is impregnated with water or alcohol-containing water. The grid cleaner 35 is sealed with a moisture impermeable film or the like until the point of use to prevent the wet sponge 38 from drying out. Reference numeral 37*b* denotes an insertion portion that is inserted into the above-described fixing holder for fixing purposes.

Now, the description of the charging device 3 shown in FIG. 8 will be continued. By sliding the charging device 3 with the grid cleaner 35 fixed thereto, the user pulls the charging device 3 out of the apparatus main body, and then inserts it thereinto. The user repeats this, whereby the grid 33 (see FIG. 7) of the charging device 3 is rubbed with the wet sponge 38 of the grid cleaner 35, and the extraneous matters on the surface of the grid 33 are removed therefrom. Between the charging device 3 and the extraction opening 36, a slight clearance (play) is secured so that the charging device 3 smoothly slides regardless of irregularities on the side of the grid 33.

FIG. 10 is a perspective view showing an apparatus front side end portion of the charging device 3, as seen from the grid 33 side. In the following description, such members as are found also in FIG. 7 will be identified with common reference numerals and their descriptions will be omitted. Reference numeral 39 denotes a gap roller that maintains the distance between the photoconductive drum 2 and the grid 33 constant and that is so disposed as to project from an opening 33*a* formed in the grid 33. The charging device 3 has, in an apparatus back side end portion thereof, another gap roller 39 having the same structure. Reference numeral 40 denotes stopper projections that prevent the charging device 3 from being disconnected from the apparatus main body at times other than during cleaning.

Next, a positional relationship between the grid and the grid cleaner as observed when the charging device 3 is pulled out during cleaning will be described with reference to FIG. 11. By inserting the insertion portion 37*b* into the fixing holder 41, the grid cleaner 35 is fixed to an apparatus main body side in such a way that the wet sponge 38 faces the grid 33. When the charging device 3 is made to slide from its standard position shown in FIG. 11A in the direction indicated by arrow A shown in the figure, the wet sponge 38 is rubbed with the gap roller 39 when the gap roller 39 passes by the grid cleaner 35 as shown in FIG. 11B. Then, as shown in FIG. 11C, the wet sponge 38 makes contact with the surface of the grid 33, whereby the extraneous matters are removed therefrom.

The problem here is that, when the method disclosed in Patent Publication 1 is adopted, water squeezed out of the wet sponge 38 when it is rubbed against the gap roller 39 may trickle down the gap roller 39, then enter the inside of the charging device 3 via the opening 33*a*, and then reach as far as the corona wire 32. In this state, moisture remaining in the charging device 3 permits excess current to flow therethrough, causing dielectric breakdown (leakage trace) of the surface of the photoconductive drum 2. This description deals with a case where the grid cleaner is fixed to the apparatus main body, and the charging device is made to slide. It should be understood, however, the same problem occurs when the grid cleaner is fitted to the charging device, and is then made to slide along it.

SUMMARY OF THE INVENTION

In view of the conventionally experienced problems described above, it is an object of the present invention to provide an image forming apparatus that can reliably clean a grid despite having a simple structure, and that prevents occurrence of leakage resulting from moisture penetrating into a charging device.

To achieve the above object, according to the present invention, in an image forming apparatus provided with: a charging device including a corona wire to which a voltage is applied for permitting corona discharge to take place, a grid provided between the corona wire and a photoconductor, and a gap roller provided to project from the surface of the grid so as to maintain the distance between the grid and the surface of the photoconductor constant, the charging device charging the surface of the photoconductor; and a cleaning member including a case and a wet sponge projecting from the case, the cleaning member that is detachable and cleans the grid, in the image forming apparatus that removes an extraneous matter attached to the surface of the grid by sliding the charging device or the cleaning member with the wet sponge kept in contact with the surface of the grid, a guide portion that prevents the gap roller and the wet sponge from rubbing against each other during cleaning of the grid is provided in the charging device or the cleaning member.

With this structure, the guide portion provided in the charging device or the cleaning member makes it possible to easily and reliably prevent the gap roller and the wet sponge from rubbing against each other during cleaning of the grid. This helps reliably remove an ion product attached to the surface of the grid, and effectively prevent dielectric breakdown of the surface of the photoconductive drum caused by penetration of moisture from the squeezed wet sponge into the charging device.

Advisably, in the image forming apparatus structured as described above, the guide portion is formed by extending a stopper projection of the charging device toward a gap roller side.

This structure helps easily and reliably prevent the gap roller and the wet sponge from rubbing against each other without providing the guide portion separately. Moreover, there is no need to change the specifications of the cleaning member, making it possible to make efficient use of a conventional cleaning member that is used in common by a plurality of models of apparatuses.

Advisably, in the image forming apparatus structured as described above, the guide portion is formed by extending a surface from which the wet sponge projects in the direction in which, when the cleaning member is fitted, a surface thereof facing away from the apparatus points.

With this structure, there is no need to change the specifications on the charging device side, and there is very little need to change the specifications on the cleaning member side. This permits the cleaning member to be used in common by a plurality of models of apparatuses as before.

Advisably, in the image forming apparatus structured as described above, the cleaning member is fitted slidably along the charging device, an engaging portion engaged with a rail portion provided in the charging device is provided so as to protrude from a surface from which the wet sponge projects, and the inclination of the cleaning member with respect to the grid is kept constant by engaging the engaging portion with the rail portion at least while the wet sponge is passing by the gap roller.

With this structure, when the cleaning member is made to slide along the charging device, the gap roller and the wet sponge are prevented from rubbing against each other due to the inclination of the cleaning member.

DETAILED DESCRIPTION OF PREFERRED EMBODIMENTS

Figure 1A:
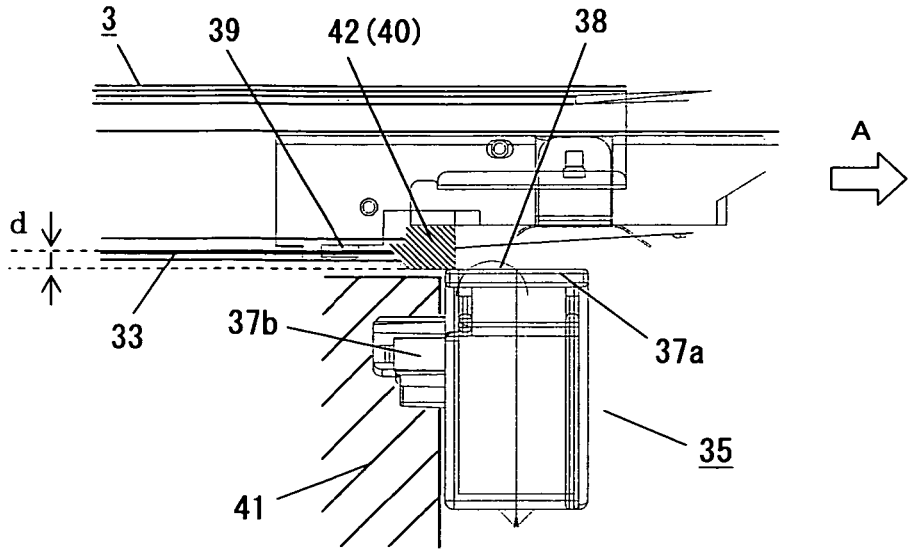
FIG. 1 is a side view showing a positional relationship between the charging device and the grid cleaner used in the image forming apparatus of a first embodiment of the present invention.

Hereinafter, embodiments of the present invention will be described with reference to the accompanying drawings. FIG. 1 is an enlarged side view showing a positional relationship between the charging device and the grid cleaner used in the image forming apparatus of a first embodiment of the present invention. In the following description, such members as are found also in the conventional example shown in FIGS. 7 to 11 will be identified with common reference numerals, and their descriptions will be omitted. In this embodiment, the stopper projections 40 for preventing the charging device 3 from being disconnected are made to extend toward the gap roller 39 side so as to serve as a guide portion 42 that prevents the wet sponge 38 of the grid cleaner 35 and the gap roller 39 from rubbing against each other.

When the charging device 3 is pulled out from its standard position (see FIG. 11A) in the direction indicated by arrow A, the guide portion 42 (stopper projections 40) makes contact with the front edge portion of the grid cleaner 35. At this time, as shown in FIG. 1A, the guide portion 42 of the charging device 3 rides onto the floor face 37*a* of the grid cleaner 35 due to the clearance between the charging device 3 and the extraction opening 36 (see FIG. 8). The charging device 3 moves in the direction indicated by arrow A while maintaining a predetermined distance d between the grid 33 and the grid cleaner 35, because the grid cleaner 35 is fixed with the insertion portion 37*b* inserted into the fixing holder 41 so that the floor face 37*a* is substantially parallel to the surface of the grid 33.

Figure 1B:
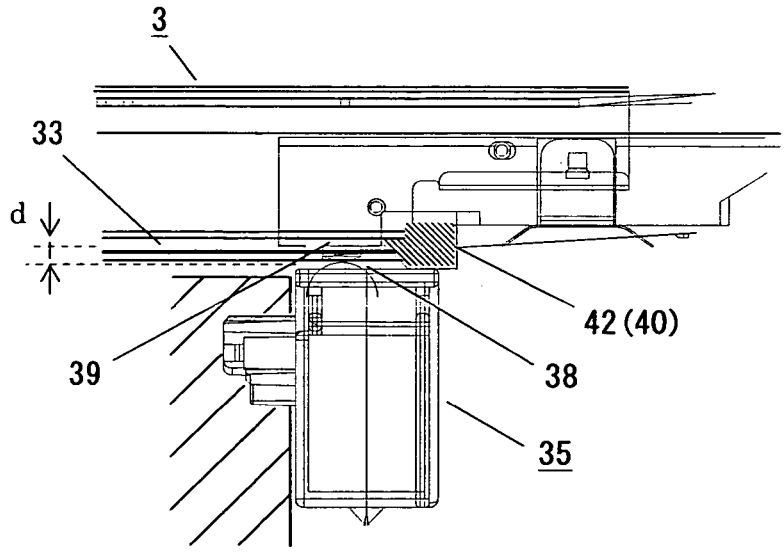

When the charging device 3 is further pulled out from the state shown in FIG. 1A, the wet sponge 38 passes by the gap roller 39 as shown in FIG. 1B. At this time, the distance d is set so that the wet sponge 38 and the gap roller 39 do not make contact with each other. This eliminates the possibility that the wet sponge 38 is rubbed with the gap roller 39 and water is squeezed out of it.

Figure 1C:
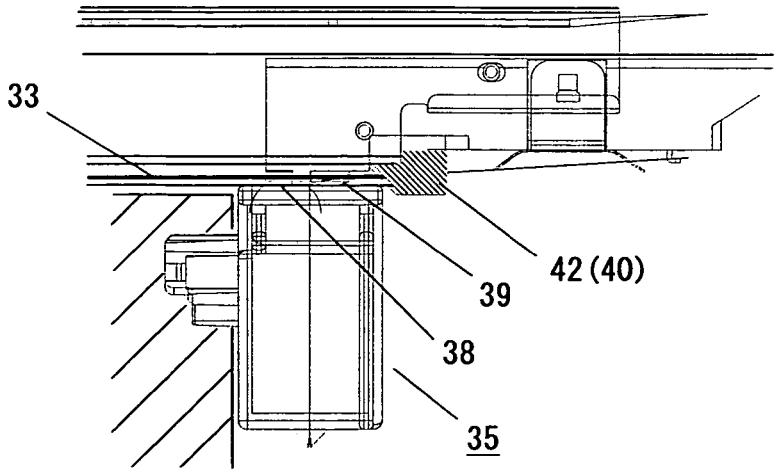

When the charging device 3 is further pulled out from the state shown in FIG. 1B, the guide portion 42 falls off the back edge of the floor face 37*a* as shown in FIG. 1C, making shorter the distance between the grid 33 and the grid cleaner 35. Accordingly, the wet sponge 38 comes into contact with the grid 33. Even then, since the wet sponge 38 has already passed by the gap roller 39, it is possible to prevent the wet sponge 38 and the gap roller 39 from rubbing against each other.

Then, the charging device 3 is fully pulled out of the apparatus and then inserted into it. By repeating such an operation, extraneous matters on the surface of the grid 33 are effectively removed therefrom, and occurrence of leakage resulting from moisture penetrating into the charging device 3 is prevented. It is to be noted that, when the charging device 3 is inserted, the transition from the state shown in FIG. 1C to the state shown in FIG. 1A through the state shown in FIG. 1B occurs, because the charging device 3 slides in the reverse direction. Also in this case, just as with the case of pulling the charging device 3, the wet sponge 38 and the gap roller 39 are prevented from rubbing against each other.

The distance d formed by the guide portion 42 may be appropriately set according to the amounts of projection of the wet sponge 38 and the gap roller 39. This embodiment deals with a case where the stopper projections 40 are made to extend toward the gap roller 39 side so as to serve as the guide portion 42. It should be understood, however, the guide portion 42 may be provided separately from the stopper projections 40.

FIG. 2 is an enlarged side view showing a positional relationship between the charging device and the grid cleaner used in the image forming apparatus of a second embodiment of the present invention. In the following description, such members as are found also in FIG. 1 will be identified with common reference numerals, and their descriptions will be omitted. In this embodiment, the floor face 37*a* of the grid cleaner 35 from which the wet sponge 38 projects is made to extend in the direction in which the charging device 3 is pulled out (the direction toward the outside of the apparatus) so as to serve as the guide portion 42.

Figure 2A:
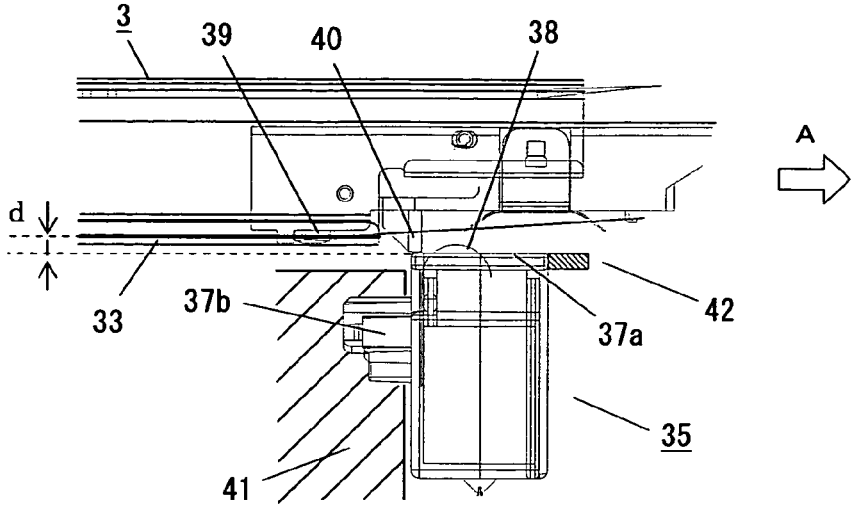
FIG. 2 is a side view showing a positional relationship between the charging device and the grid cleaner used in the image forming apparatus of a second embodiment of the present invention.

When the charging device 3 is pulled out from its standard position (see FIG. 11A) in the direction indicated by arrow A, the stopper projections 40 of the charging device 3 ride onto the floor face 37*a* of the grid cleaner 35 as shown in FIG. 2A. Since the floor face 37*a* of the grid cleaner 35 is held so as to be substantially parallel to the surface of the grid 33 in a similar manner as described in the first embodiment, the charging device 3 moves in the direction indicated by arrow A while maintaining a predetermined distance d between the grid 33 and the grid cleaner 35.

Figure 2B:
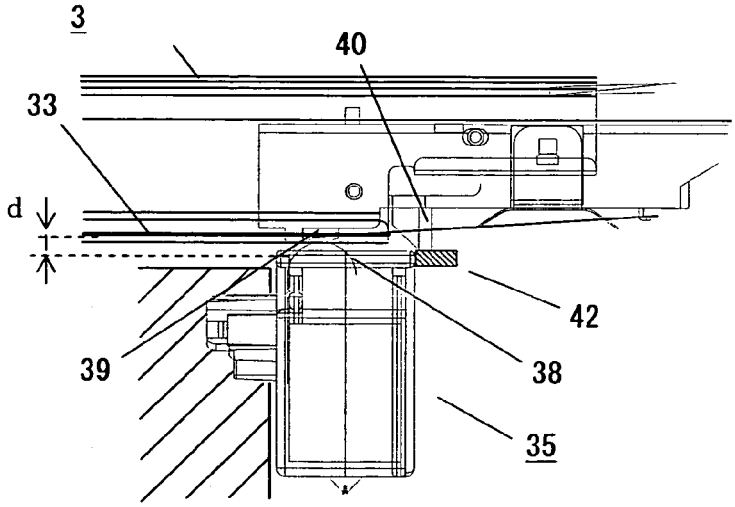

When the charging device 3 is further pulled out from the state shown in FIG. 2A, the wet sponge 38 passes by the gap roller 39 as shown in FIG. 2B. At this time, since the stopper projections 40 are in contact with the guide portion 42 extending from the floor face 37*a*, the wet sponge 38 does not make contact with the gap roller 39.

Figure 2C:
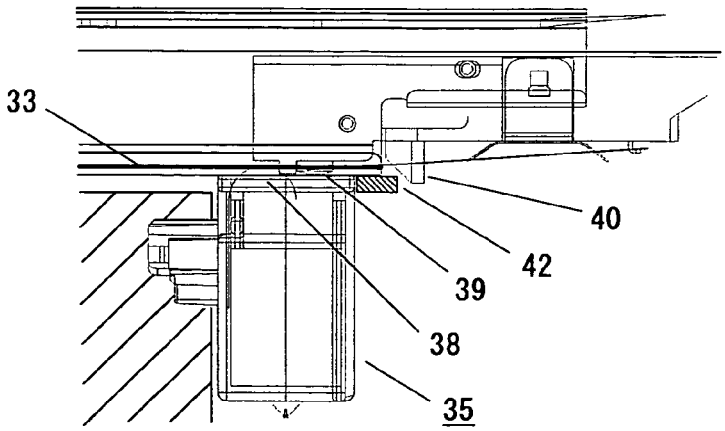

When the charging device 3 is further pulled out from the state shown in FIG. 2B, the back edge of the guide portion 42 falls off the stopper projections 40 as shown in FIG. 2C, making shorter the distance between the grid 33 and the grid cleaner 35. Accordingly, the wet sponge 38 comes into contact with the grid 33. Even then, since the wet sponge 38 has already passed by the gap roller 39, as with the first embodiment, it is possible to prevent the wet sponge 38 and the gap roller 39 from rubbing against each other.

Then, the charging device 3 is fully pulled out of the apparatus and then inserted into it. By repeating such an operation, extraneous matters on the surface of the grid 33 are effectively removed therefrom, and occurrence of leakage resulting from moisture penetrating into the charging device 3 is prevented. It is to be noted that a positional relationship between the wet sponge 38 and the grid 33 observed when the charging device 3 is inserted, and the value of the distance d formed by the guide portion 42 are the same as in the first embodiment, and therefore descriptions thereof will be omitted.

Instead of providing the guide portion 42 by extending the floor face 37*a* of the grid cleaner 35, it is possible to make the entire case 37 wider in the direction in which the charging device 3 slides. Considering, however, that the grid cleaner 35 is usually designed for use in a plurality of models of image forming apparatuses, there is a possibility that the wider case 37 cannot be used in another image forming apparatus. Accordingly, it is preferable to employ the structure of this embodiment in which the guide portion 42 is provided by extending the floor face 37*a* alone. Alternatively, a structure may be employed in which the guide portion 42 is provided separately from the case 37, and fitted to the case 37 according to the type of image forming apparatus.

Figure 3:
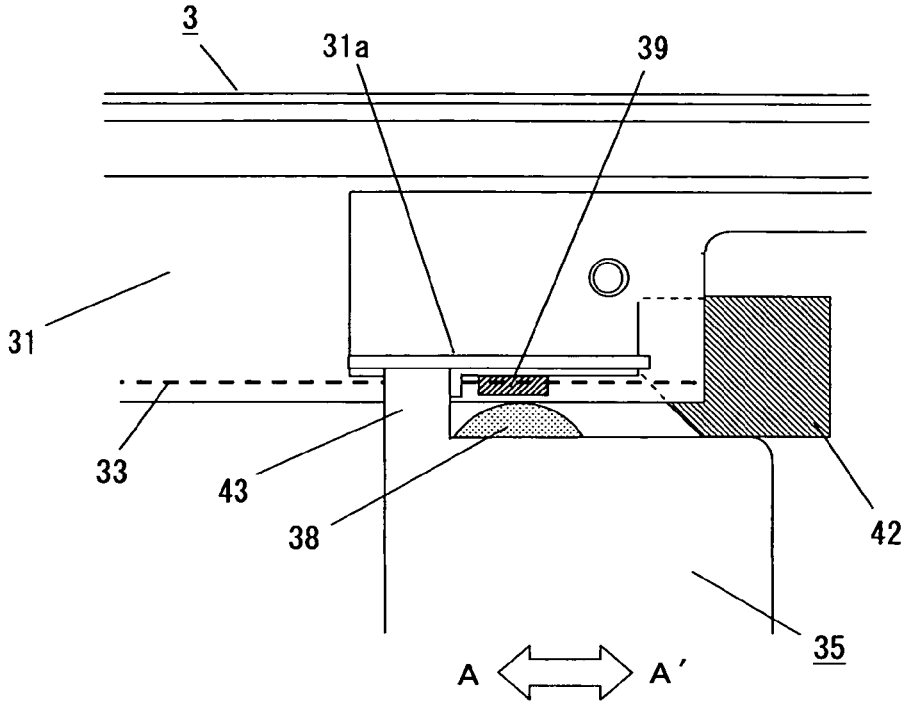
FIG. 3 is a side view showing a positional relationship between the charging device and the grid cleaner used in the image forming apparatus of a third embodiment of the present invention.
Figure 4A:
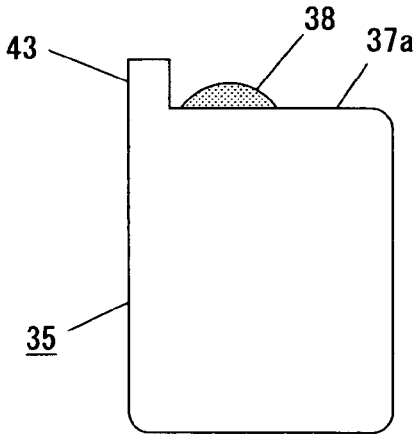
FIG. 4 is a side view of the grid cleaner used in the third embodiment and an enlarged front view of the wet sponge thereof and the surrounding portion.
Figure 4B:
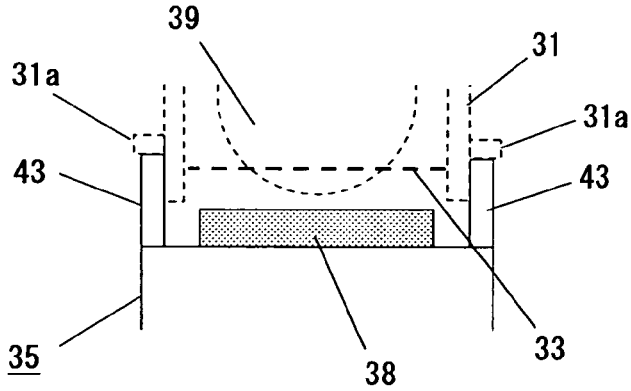

Next, a third embodiment of the present invention will be described with reference to FIGS. 3 and 4. FIG. 3 is an enlarged side view showing a positional relationship between the charging device and the grid cleaner used in the image forming apparatus of the third embodiment. FIG. 4A is a side view of the grid cleaner, and FIG. 4B is an enlarged front view of the wet sponge of the grid cleaner and the surrounding portion. This embodiment differs from the first embodiment in that, instead of the structure in which the grid cleaner 35 is fixed to the apparatus main body and the charging device 3 is made to slide, a structure in which the grid cleaner 35 is fitted to the charging device 3 and is made to slide in the direction indicated by arrow AA' along the charging device 3 is employed.

Figure 5:
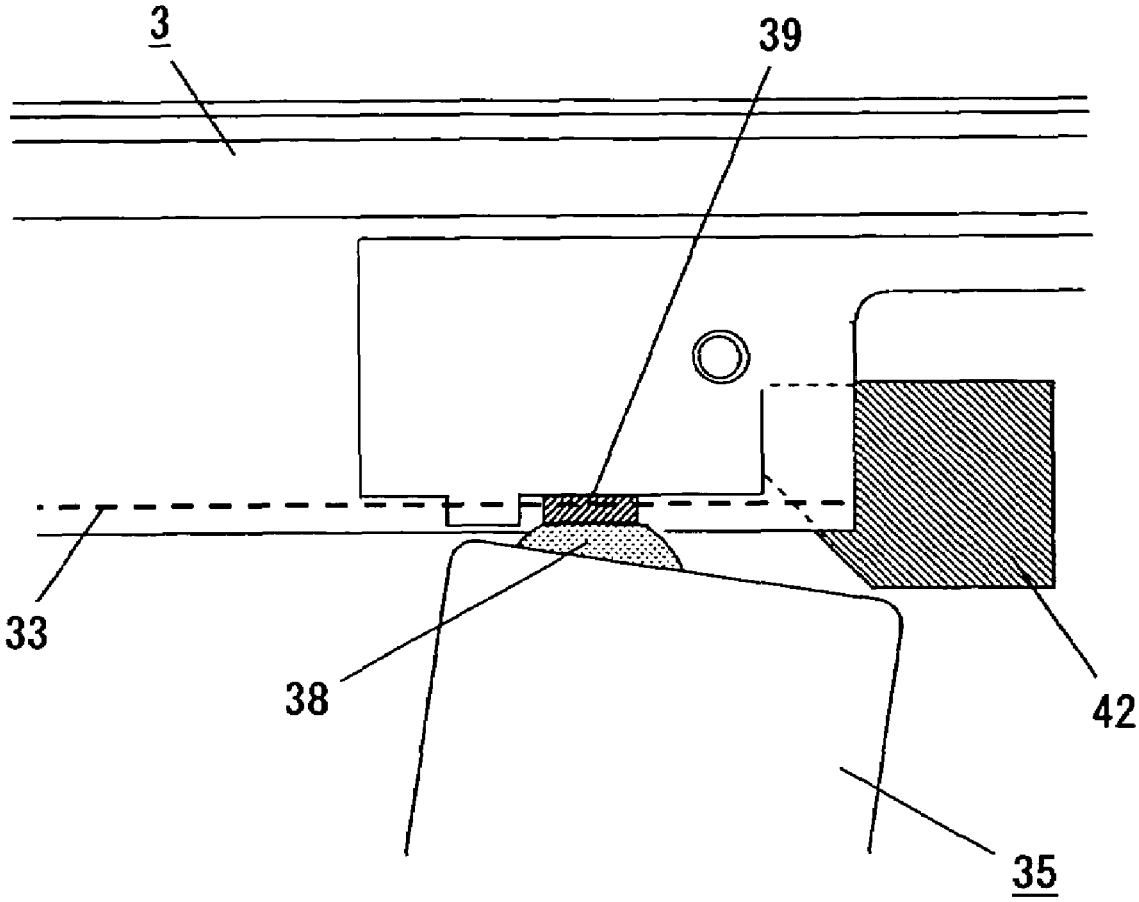
FIG. 5 is a schematic side view showing a relationship between the wet sponge and the gap roller when the grid cleaner is inclined with respect to the grid surface.
Figure 6:
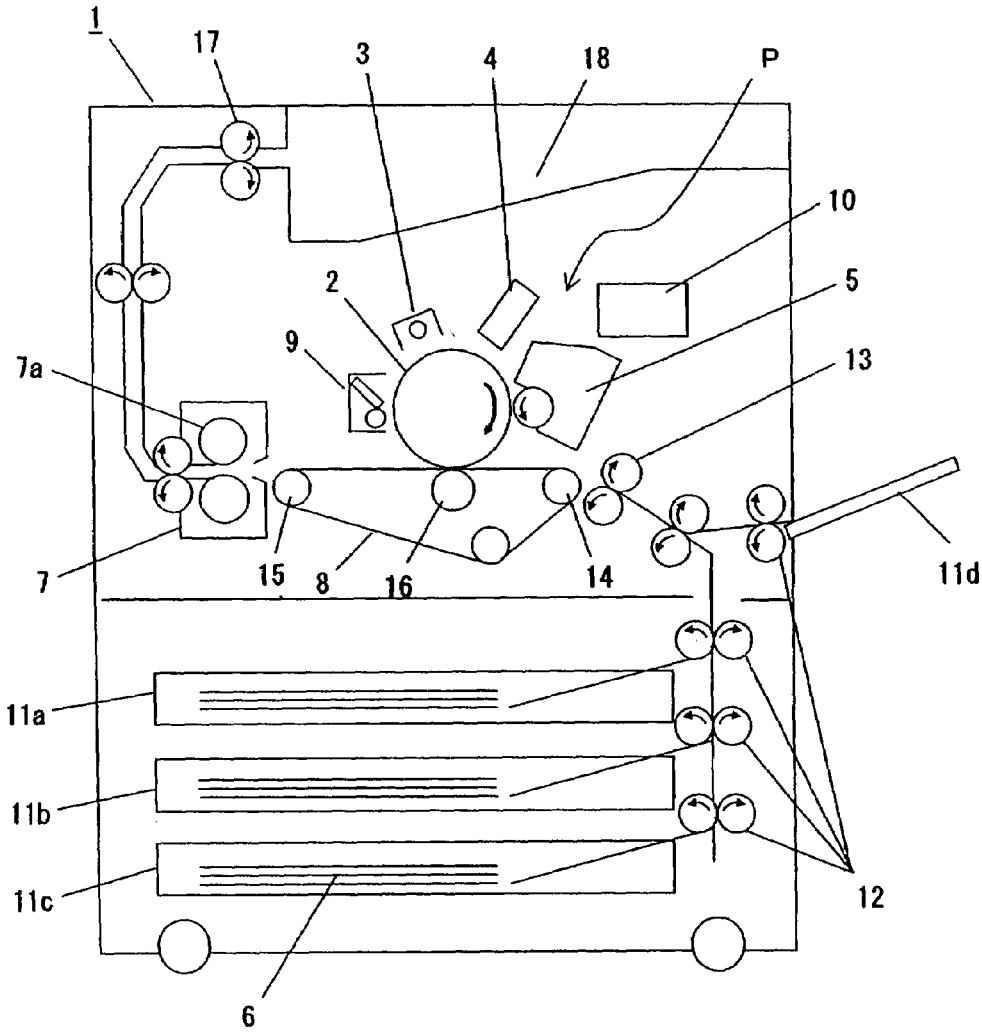
Fig. 6 PRIOR ART
FIG. 6 is a schematic diagram showing the entire structure of a conventional image forming apparatus.
Figure 7:
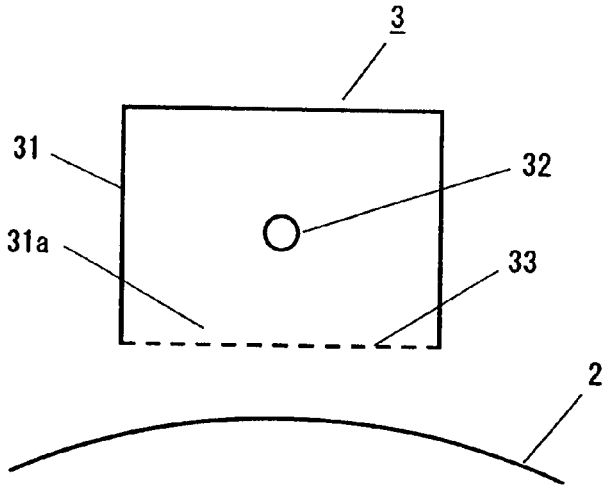
Fig. 7 PRIOR ART
FIG. 7 is a schematic sectional view showing the structure of a conventional scorotron.
Figure 8:
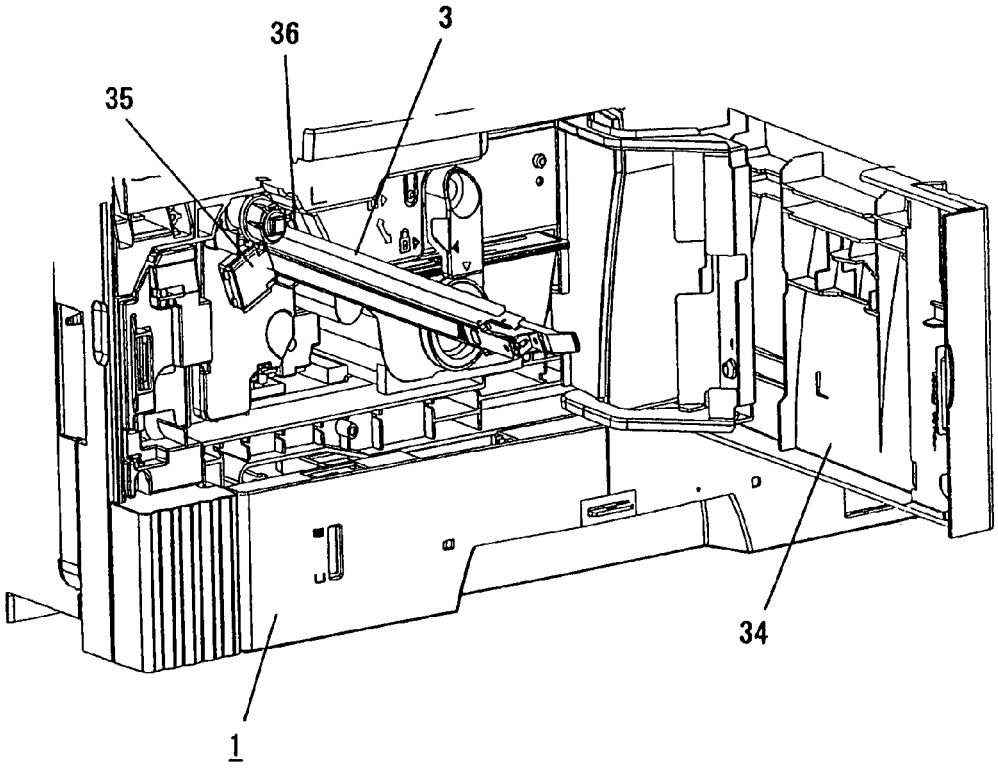
Fig. 8 PRIOR ART
FIG. 8 is an enlarged perspective view showing how the charging device of the conventional image forming apparatus is cleaned.
Figure 9:
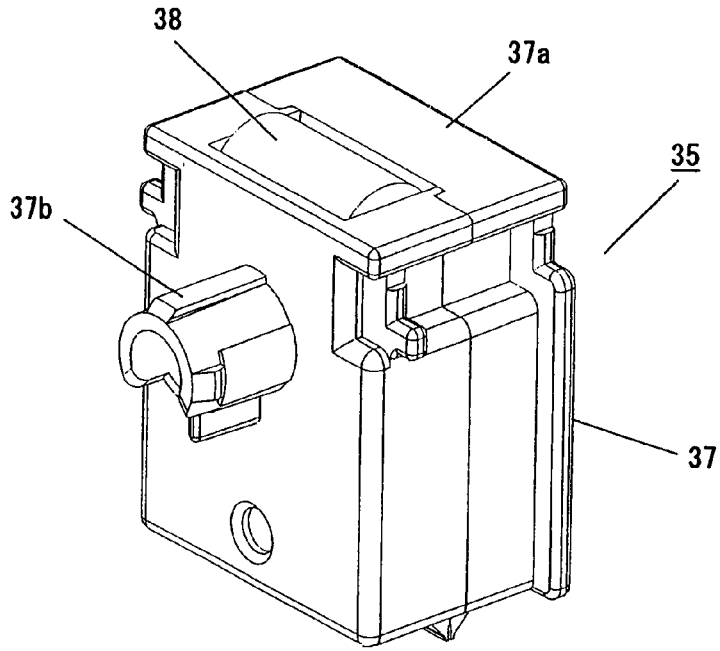
Fig. 9 PRIOR ART
FIG. 9 is a perspective view showing the structure of the grid cleaner.
Figure 10:
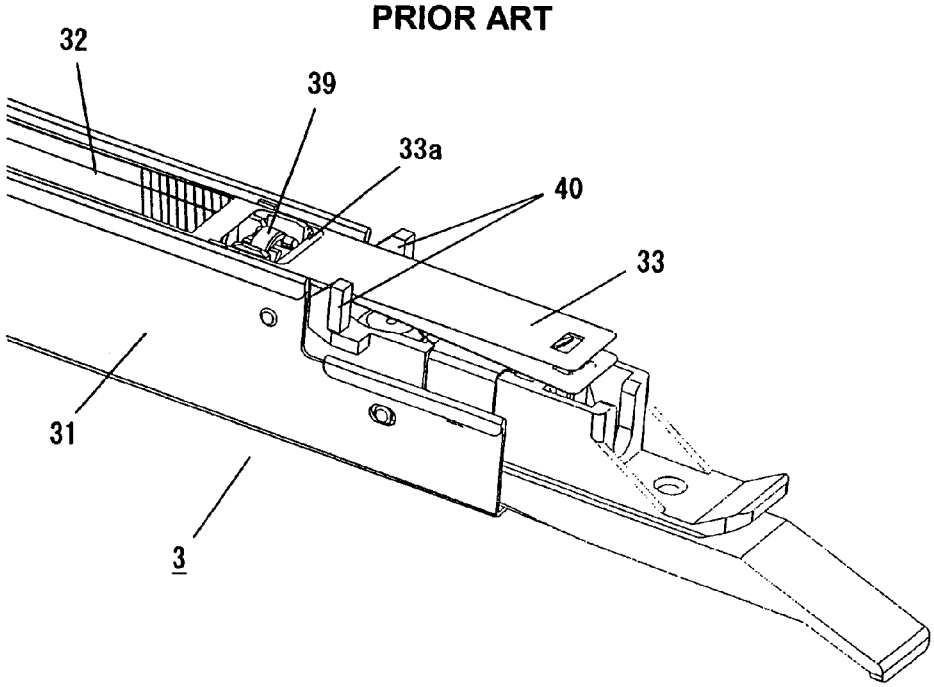
Fig. 10 PRIOR ART
FIG. 10 is an enlarged perspective view showing an apparatus front side end portion of the charging device, as seen from the grid side.
Figure 11A:
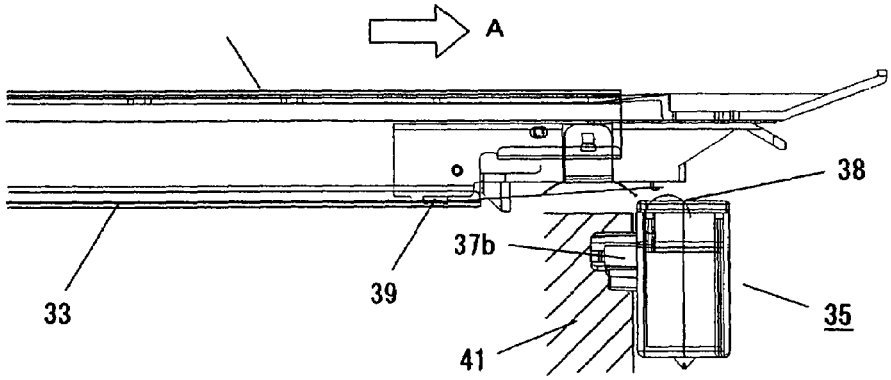
Fig. 11 a PRIOR ART
FIG. 11 is a side sectional view showing a positional relationship between a conventional grid and a conventional grid cleaner.
Figure 11B:
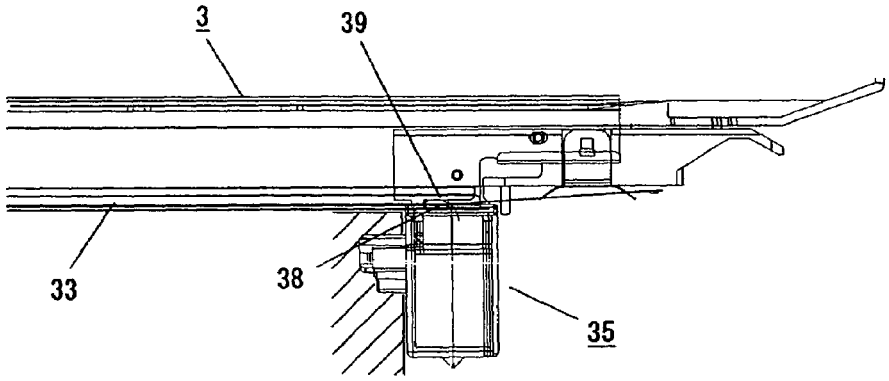
Fig. 11 b PRIOR ART
Figure 11C:
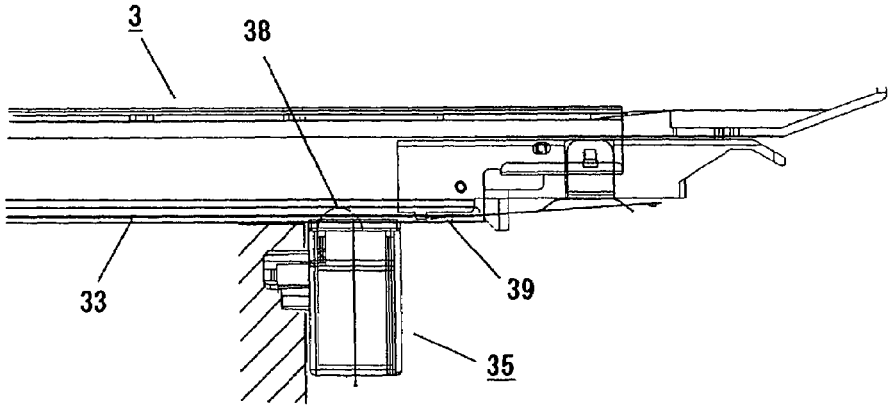
Fig. 11 c PRIOR ART

When the grid cleaner 35 is made to slide along the charging device 3, if the grid cleaner 35 is inclined with respect to the surface of the grid 33 when the floor face 37*a* passes by the guide portion 42, there is a possibility that the wet sponge 38 makes contact with the gap roller 39, as shown in FIG. 5, and water is squeezed out of it. Therefore, as shown in FIGS. 3 and 4, a rail portion 31*a* is provided on the charging device 3 side in a predetermined position on the side surface of the shield member 31, and an engaging portion 43 protruding from the floor face 37*a* is provided on the grid cleaner 35 side.

With this structure, the engaging portion 43 is engaged with the rail portion 31*a* when the wet sponge 38 is passing by the gap roller 39, and the floor face 37*a* is held so as to be substantially parallel to the surface of the grid 33. This makes it possible to prevent the wet sponge 38 and the gap roller 39 from making contact with each other. Here, other components of the charging device 3 and the grid cleaner 35 are found also in the first embodiment, and their descriptions will not be repeated.

This embodiment deals with a case where the grid cleaner 35 is made to slide in the structure of the first embodiment in which the stopper projections 40 are made to extend so as to serve as the guide portion 42. It is needless to say that the structure of this embodiment can be applied similarly to the structure of the second embodiment in which the floor face 37*a* of the grid cleaner 35 is made to extend so as to serve as the guide portion 42.

Obviously, many modifications and variations of the present invention are possible in light of the above teachings. It is therefore to be understood that within the scope of the appended claims, the invention may be practiced other than as specifically described. For example, the charging device 3 may be pulled out in a lateral or back direction of the apparatus, instead of a front direction thereof. Moreover, the shape, size, position, and the like of the grid cleaner and the wet sponge are appropriately set according to the specifications of the image forming apparatus. Moreover, the present invention can be applied to various types of image forming apparatuses using a charging device to charge the surface of the photoconductor, such as copiers including digital multifunction devices, tandem-type color copiers, and analog monochrome copiers, facsimiles, and laser printers.

According to the present invention, it is possible to effectively remove extraneous matters on the surface of a grid by using a wet sponge, and reliably prevent a gap roller and the wet sponge from rubbing against each other during cleaning of the grid. This makes it possible to provide an image forming apparatus that effectively prevents dielectric breakdown of the surface of the photoconductive drum caused by moisture from the wet sponge, and that can be produced with ease and at low cost.

Moreover, extending a stopper projection of a charging device toward the gap roller side so as to use it also as a guide portion helps easily and reliably prevent the gap roller and the wet sponge from rubbing against each other without greatly changing the specifications of the charging device. Moreover, there is no need to change the specifications of a cleaning member, making it possible to make efficient use of a conventional cleaning member that is used in common by a plurality of models of apparatuses.

Moreover, extending the surface of the cleaning member from which the wet sponge projects so as to use it also as the guide portion eliminates the need to change the specifications of the charging device, and makes it possible to easily and reliably prevent the gap roller and the wet sponge from rubbing against each other without greatly changing the specifications of the cleaning member. This permits the cleaning member to be used in common by a plurality of models of apparatuses as before.

When the cleaning member is made to slide along the charging device, there is a possibility that the wet sponge and the gap roller make contact with each other depending on the inclination of the cleaning member. This can be avoided by providing, on a surface from which the wet sponge projects, an engaging portion that is engaged with a rail portion provided on the charging device side, and engaging the engaging portion with the rail portion at least while the wet sponge is passing by the gap roller. This permits the inclination of the cleaning member to be kept constant, making it possible to prevent the gap roller and the wet sponge from making contact with each other.

What is claimed is:

1. An image forming apparatus comprising:

a charging device including a corona wire to which a voltage is applied for permitting corona discharge to take place, a grid provided between the corona wire and a photoconductor, and a gap roller provided to project from a surface of the grid so as to maintain a distance between the grid and a surface of the photoconductor constant, the charging device charging the surface of the photoconductor;

a cleaning member that is detachably fitted to an apparatus main body or the charging device so as to clean the surface of the grid, the cleaning member including a case, and a wet sponge projecting from the case; and a guide portion that is provided in the charging device or the cleaning member so as to prevent the gap roller and the wet sponge from rubbing against each other, and the image forming apparatus that removes an extraneous matter attached to the surface of the grid by sliding the charging device or the cleaning member with the wet sponge kept in contact with the surface of the grid.

2. The image forming apparatus of claim 1, wherein the guide portion is formed by extending a stopper projection of the charging device toward a gap roller side.

3. The image forming apparatus of claim 1, wherein the guide portion is formed by extending a surface from which the wet sponge projects in a direction in which, when the cleaning member is fitted, a surface thereof facing away from the apparatus points.

4. The image forming apparatus of claim 1, wherein the cleaning member is fitted slidably along the charging device, wherein an engaging portion engaged with a rail portion provided in the charging device is provided so as to protrude from a surface from which the wet sponge projects, and wherein an inclination of the cleaning member with respect to the grid is kept constant by engaging the engaging portion with the rail portion at least while the wet sponge is passing by the gap roller.

5. The image forming apparatus of claim 2, wherein the cleaning member is fitted slidably along the charging device, wherein an engaging portion engaged with a rail portion provided in the charging device is provided so as to protrude from a surface from which the wet sponge projects, and wherein an inclination of the cleaning member with respect to the grid is kept constant by engaging the engaging portion with the rail portion at least while the wet sponge is passing by the gap roller.

6. The image forming apparatus of claim 3, wherein the cleaning member is fitted slidably along the charging device, wherein an engaging portion engaged with a rail portion provided in the charging device is provided so as to protrude from a surface from which the wet sponge projects, and wherein an inclination of the cleaning member with respect to the grid is kept constant by engaging the engaging portion with the rail portion at least while the wet sponge is passing by the gap roller.

* * * * *